United States Patent [19]

Uke

[11] 4,112,521

[45] Sep. 12, 1978

[54] QUICK ADJUST STRAP FOR DIVER'S FACE MASK

[76] Inventor: Alan K. Uke, 2306 Ocean Front, Del Mar, Calif. 92014

[21] Appl. No.: 774,127

[22] Filed: Mar. 3, 1977

Related U.S. Application Data

[63] Continuation of Ser. No. 542,724, Jan. 21, 1975, abandoned.

[51] Int. Cl.[2] ..... A61F 9/02

[52] U.S. Cl. ..... 2/452; 2/428; 2/DIG. 6; 24/201 A

[58] Field of Search ..... 2/452, 428, 429, 430, 2/9, DIG. 6; 24/265 AL, 265 WS, DIG. 18, 201 A, 204; 224/4 D; 128/141 R, 146.7

[56] References Cited

U.S. PATENT DOCUMENTS

| | | | |
|---|---|---|---|
| 1,719,849 | 7/1929 | Person | 224/4 D |
| 2,538,265 | 1/1951 | Paston | 224/4 D |
| 2,876,766 | 3/1959 | Rebikoff et al. | 2/430 X |
| 3,457,564 | 7/1969 | Holloway | 2/452 X |

FOREIGN PATENT DOCUMENTS

| | | | |
|---|---|---|---|
| 78,310 | 11/1918 | Switzerland | 224/4 D |
| 430,494 | 8/1967 | Switzerland | 2/DIG. 6 |

OTHER PUBLICATIONS

Red Lions Products, "Free Flex Band Supports Elbow," May 8, 1973.

*Primary Examiner*—Peter Nerbun
*Attorney, Agent, or Firm*—Brown & Martin

[57] ABSTRACT

A quick adjust strap for ready connection and release of a diver's face mask. A headband is connected to brackets on the sides of the face mask. One end of the headband is received in a ring of one bracket and nipples thereon lock with a slider member thereof. A ribbon of material is connected to the other end of the headband and is received through a ring of the other bracket and folded back over itself. The ribbon is coated with a tacky material, such as a Velcro cloth and a Velcro gripper, which when brought into contact will maintain the fold and secure the headband about the diver's head with precise adjustment. Sandwiched between the gripper part and the cripping cloth is a finger tab that may be readily gripped by the diver to affect a quick release of the face mask from the diver's head. The finger tab is larger than the bracket by which it is attached to the mask so that accidental release and loss of the mask is prevented.

6 Claims, 3 Drawing Figures

QUICK ADJUST STRAP FOR DIVER'S FACE MASK

This is a continuation of application, Ser. No. 542,724, filed Jan. 21, 1975 now abandoned.

BACKGROUND OF THE INVENTION

The present invention relates to a quick adjusting strap for a diver's face mask.

Diving, whether of the scuba or snorkel variety, requires that the diver remove and replace the diving mask at extremely frequent intervals. Upon emerging from the water, the diver will often want to remove the mask so that he will have better visibility and to return to normal breathing. Furthermore, from time to time, the mask will have to be adjusted while the diver is submerged due to the different coefficients of expansion of the various components.

In the past, these manipulations necessary to connect and release the headband have been rather inconvenient, often effected by means of a snap connected to the end of a strap, which provides incremental adjustment. THe problem associated with such a device is that the diver cannot see the position of the male and female parts of the snap and often must fumble before making connection. Also he may have insufficient feeling in his fingertips because of the coolness of the water, or because he is wearing gloves, so that it may be difficult for him to align for male and female parts of the snap. This is particularly critical when the diver is submerged since excess fumbling with the strap may cause the mask to be off-set from the face slightly which would permit water to enter and imperil the diver's activities.

There are other methods of securing the headband such as by means of a buckle or other similar devices. These devices exhibit the same deficiencies as the snap in that they are difficult to manipulate with one hand, particularily for a submerged diver. The instant invention is designed to provide a quick release strap which may be adjusted by the diver with one hand and which relies in a very small way upon the manipulative abilities of the diver. The instant invention is particularly suitable for manipulations undertaken while the diver is submerged, which manipulation can take place without the fear of seepage into the mask.

SUMMARY OF THE INVENTION

It is a primary object of the instant invention to provide a new and improved quick release headband for a diving mask.

Another object of the instant invention is the provision of a quick release headband which may be adjusted while a diver is submerged.

Yet another object of the instant invention is the provision of a quick release headband which may be connected and released without dependence on the diver's manipulative abilities.

In accordance with the above designs, the instant invention comprises a conventional headband, one end of which is inserted into a bracket connected to one side of the mask, which interconnection is semi-permanent in that it is designed for occasional adjustment to conform to the size of the diver's head. That end of the headband is provided with a series of ribs or nipples which maintain the connection to that bracket by locking with a sliding member thereof.

At the other end of the headband is connected a ribbon of tacky material, the free end of which is designed for connection to a bracket on the other side of the diver's mask. The connection between the headband and the ribbon may be affected by providing slots in the headband and looping one end of the ribbon through the slots and folding it back over itself, the joint being secured by means of a stitched seam. The ribbon may be composed of a tacky gripping cloth and gripper commonly referred to as VELCRO. Sandwiched between the gripper and the gripping cloth is a resilient finger tab which is easily gripped by the diver and permits an easy fold of the gripping cloth over itself for connection and release of the gripper to the gripping cloth. The finger tab is larger than the opening in the bracket and will not become detached if the diver accidentally loses grip.

The above and other aspects of the instant invention will be apparent as the description continues and when read in conjunction with the appended drawings.

DETAILED DESCRIPTION OF THE DRAWINGS

Figure 1:
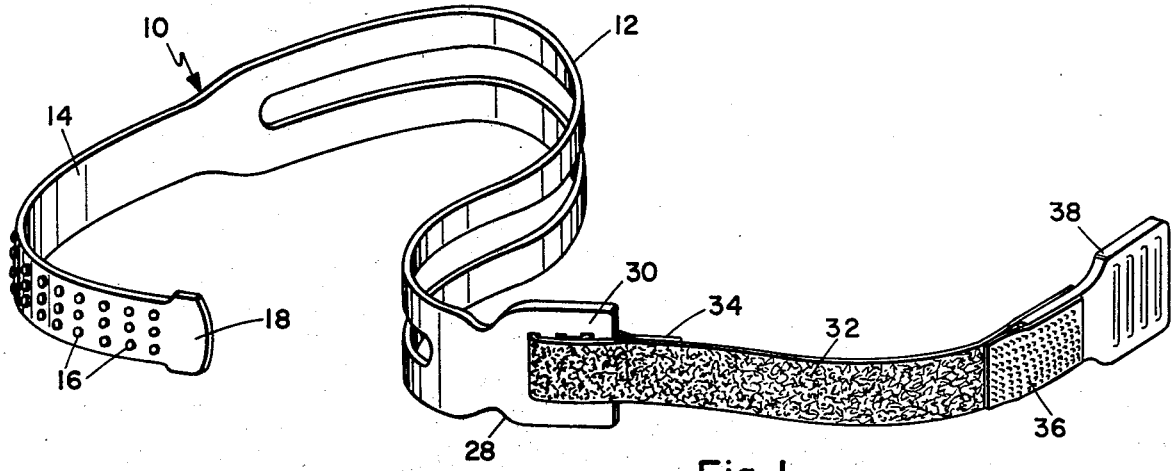
FIG. 1 is the perspective view of the strap.
Figure 3:
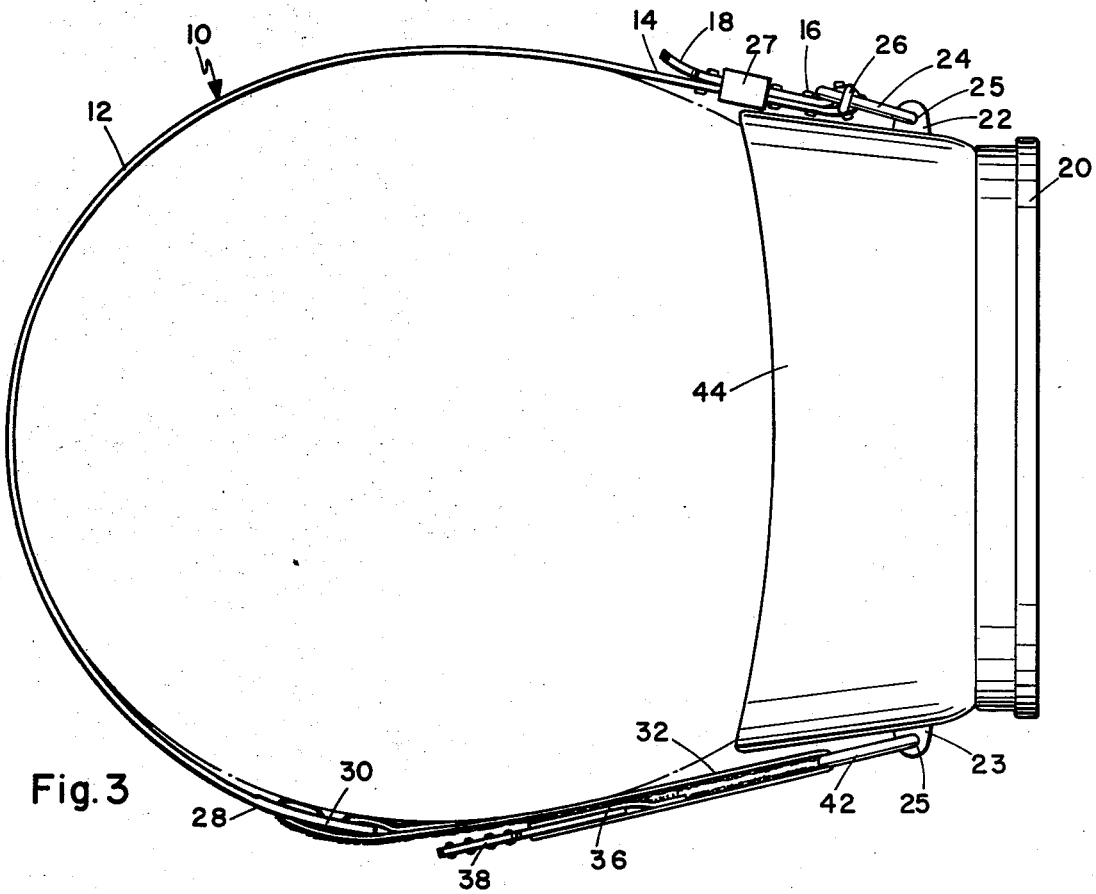
FIG. 3 is a top plan view of a typical face mask worn with the strap attached.

Referring to FIG. 1, the strap 10 is of essentially conventional construction comprising a slotted center section 12 which is adapted to enclose the back portion of the diver's head. The slotted construction provides for substantial stretching which is necessary in connecting the face mask to the head. One end 14 of the strap 10 is more narrowly constructed and on its outer surface provides for a plurality of nipples 16 which extend all the way to the tab tip 18. As shown in FIG. 3, the diver's mask 20 includes a pair of brackets 22, 23 which are of a conventional nature and generally comprise a ring 24 pivotally mounted within a hinge 25. The end 14 is connected to the bracket 22 by means of inserting that end through the ring 24 and winding it over a slider 26 and then back through the ring so that it is folded over itself. The effect of the pulling force of the headband 10 and the locking effect of the nipples 16 maintain the connection between the headband and the bracket 22 in a semi-permanent manner. This interconnection will only be adjusted when it is necessary to coarsely adapt the headband to the head size of the diver and a keeper sleeve 27 may be fitted over the folded end to secure the free end. In the majority of instances, that interconnection will not be disturbed and interconnection and release of the headband will be effected by the structure hereinafter described.

Figure 2:
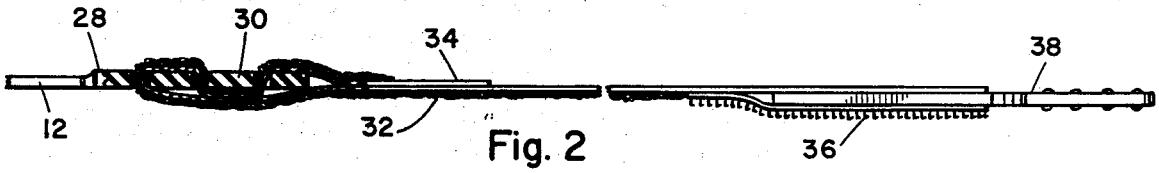
FIG. 2 is a top plan view, partially cut away, of the quick adjustment end of the strap.

As shown in FIGS. 1 and 2, the opposite end 28 of the headband 10 comprises a triple slot tab 30. A ribbon 32 of a tacky material is looped through the slots and doubled over itself. The end 34 may be sewn to the underlying part of the ribbon 32 or an insoluble cement may be utilized for this purpose. The ribbon 32 is coated on its exterior with a tacky or adhesive material. It has been found convenient to utilize a VELCRO gripping cloth for such material. In conjunction with the utilization of a VELCRO gripping cloth, a gripping pad 36 is employed at the free end of the ribbon 32. A finger tab 38 is sandwiched between the ribbon 32 and the gripping pad 36 all of which are interconnected via a stitched seam. However, an insoluble cement or other suitable means is also contemplated to affect this connection.

FIG. 3 illustrates connection of the free end of ribbon 32 to bracket 23 by a ring 42, to which the ribbon 32 affects a quick connection or release. The tab 38 and gripper pad 36 are received through the ring 42 and a portion of the ribbon 32 also passes through that ring. The ribbon 32 is folded back over itself to the extent that it is received through the ring 42 and the gripping pad 36 is brought into contact with the gripping cloth. The face piece 44 of the mask 20 is generally of a flexible material and consequently the strap may be pulled as tightly as may be comfortable.

The resilient tab 38 may be conveniently gripped by the diver at any time, under or above the water, for adjustment or release of the mask from the face. The diver need not depend on his manipulative ability in aligning the tab 38 with the ribbon 32 since slight misalignments in no way effect the security of the connection. This is of particular importance when a diver is submerged and his manipulative abilites are slightly diminished sometimes due to the coolness of the water. For additional security and to prevent accidental loss of the face mask, finger tab 38 is larger than the opening through ring 42 and must be forced through the ring during assembly. Thus if the diver loses grip of tab 38, it will not pull out of ring 42 and the mask will not fall free. Quick and efficient adjustments in the strap tension may be affected without the fear of seepage through the face piece 44 of the mask 20.

Modification and adaptions in the method and material of the fabrication in the configuration and assemblage of the constituent elements are readily permissible within the scope of the instant invention, which changes are intended to be embraced therewithin.

Having described my invention, I now claim:

1. A quick adjust strap for a diver's face mask equipped with brackets and attachment rings on each side of the mask for the connection of the strap thereto, said strap comprising, a flexible resilient headband to enclose a diver's head and provided with slots in one end, a flexible ribbon attached to one end of said headband for being threaded through the face mask attachment rings and doubling back upon itself, said ribbon having a tacky material on a face thereof.

said ribbon being foldable back upon itself with the tacky material maintaining the fold and permitting fold separation only by application of an outward pulling force on said ribbon fold, a resilient tab formed on one free end of said ribbon that is grippable for adjustment of the strap, said tab being larger than the opening in the associated attachment ring such that it must be forced through the attachment ring when threading said ribbon through the attachment ring, said ribbon being superimposed over a part of said tab and permanently fixed thereto in the overlapping area of said ribbon and said tab, said tab having a first end extending between the end portions of said tacky material and said ribbon, said tab forming a backing for said tacky material for allowing greater force to be applied when making the connection to the tacky material on said ribbon surface, said tab having an integral second end with a thickness and width substantially larger than the thickness and width of said ribbon, said tacky material only covering the first end portion of said tab leaving the enlarged second end free from connection to said tacky material and being spaced therefrom for making said second end readily locatable and grippable.

2. In the strap of claim 1, the other end of said ribbon is looped between slots in said headband and folded back on itself having a stitched seam interconnection.

3. In the strap of claim 1, the other end of said ribbon is looped between slots in said headband and folded back on itself having water insoluble adhesive interconnection.

4. The strap of claim 1, wherein, said tacky material comprises cooperating hook and pile fastening means for being separated by pulling said tab outwardly, and the hook part of the fastening means is disposed in superimposed relation with a part of the tab.

5. The strap of claim 4, wherein, said hook part and said tab are interconnected by a stitched seam.

6. The strap of claim 4, wherein;

said hook part and said tab are interconnected by a water insoluable adhesive.

* * * * *